United States Patent [19]

Hermanson

[11] 4,182,353

[45] Jan. 8, 1980

[54] STRETCHABLE PLASTIC FILM UMBRELLA

[76] Inventor: Terry Hermanson, c/o Mr. Christmas Inc., 41 Madison Ave., New York, N.Y. 10010

[21] Appl. No.: 954,154

[22] Filed: Oct. 24, 1978

[51] Int. Cl.[2] ..... A45B 15/00; A45B 23/00; A45B 11/00

[52] U.S. Cl. ..... 135/19.5; 135/20 R

[58] Field of Search ..... 135/19.5, 20 R, 25, 135/33 R

[56] References Cited

U.S. PATENT DOCUMENTS

| | | | |
|---|---|---|---|
| 1,457,679 | 6/1923 | Vincent | 135/20 |
| 1,580,864 | 4/1926 | Stevenson | 135/19.5 |
| 1,752,820 | 4/1930 | Timblin | 135/19.5 |
| 1,752,821 | 4/1930 | Timblin | 135/19.5 |

*Primary Examiner*—Reinaldo P. Machado
*Attorney, Agent, or Firm*—Karl W. Flocks

[57] ABSTRACT

This invention relates to an umbrella of the disposable type and more particularly to an umbrella which may be quickly fabricated of inexpensive materials.

1 Claim, 9 Drawing Figures

STRETCHABLE PLASTIC FILM UMBRELLA

BACKGROUND OF THE INVENTION

Prior to the instant invention, attempts have been made to produce disposable umbrellas and with some degree of success in that such attempts have included inexpensive materials and have included canopies and handles. However, these prior attempts do not have all the advantages of the construction in accordance with the instant invention.

SUMMARY OF THE INVENTION

It is an object of the instant invention to teach the construction of a disposable type umbrella wherein the canopy serves to bring together in interfitted relationship the handle parts which are relatively rigidly integral with the canopy support parts and hold same as if locked.

It is a further object of the instant invention to so form the integral handle parts and canopy support parts and assemble same with a relatively elastic canopy that during the setting up of the umbrella by movement of the handle parts the initially loose canopy is first stretched and then snapped into its final position by a toggle-like action.

Other objects and the nature and advantages of the instant invention will be apparent from the following description taken in conjunction with the accompanying drawings, wherein:

DETAILED DESCRIPTION OF THE INVENTION

Figure 1:
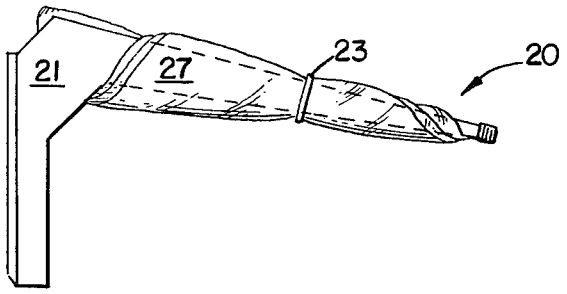
FIG. 1 is a view in side elevation of the umbrella with the canopy furled.

Referring to the drawings, the umbrella 20 has for its principal parts a canopy 27 and a supporting structure comprising two discrete frame elements 21 and 22.

Each of the frame elements 21 and 22 comprise two generally boomerang-shaped elements hingedly connected together along the inner side 33 of the integral handle portions 25, 25, 25, 26. Each of the two generally boomerang-shaped elements also include two canopy supporting booms 24, 24, so that, when the umbrella is open, four booms 24, 24, 24, 24 support the canopy 27.

In FIG. 1, the umbrella is shown in closed position with the folded canopy 27, which is of flexible film material, wrapped about the four booms 24, 24, 24, 24 and held in place by a band 23 which may be a rubber band or strap.

Figure 2:
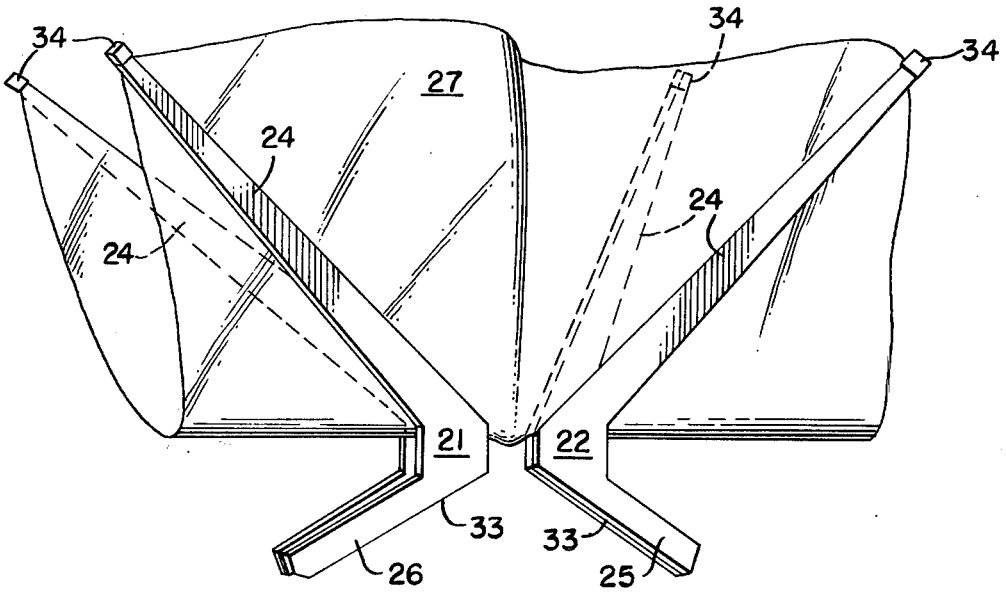
FIG. 2 is a view principally in elevation and somewhat in perspective of an initial step in setting up the umbrella after the unfurling of the canopy.

When the band 23 is removed and the canopy 27 unfurled, each set of two booms 24, 24 may be spread apart somewhat as shown in FIG. 2. This spreading apart manipulation is accomplished by the user who holds handle portions 25, 25 in one hand and handle portions 25, 26 in the other hand in such a manner that the two boomerang-shaped elements are not touching each other and the very center of the canopy 27 hangs loose. In the position illustrated in FIG. 2, the canopy 27, which is secured to ends 34, 34, 34, 34 of the booms 24, 24, 24, 24 and which also may be secured to the tops or long edges of the booms, festoons freely between the booms.

Figure 3:
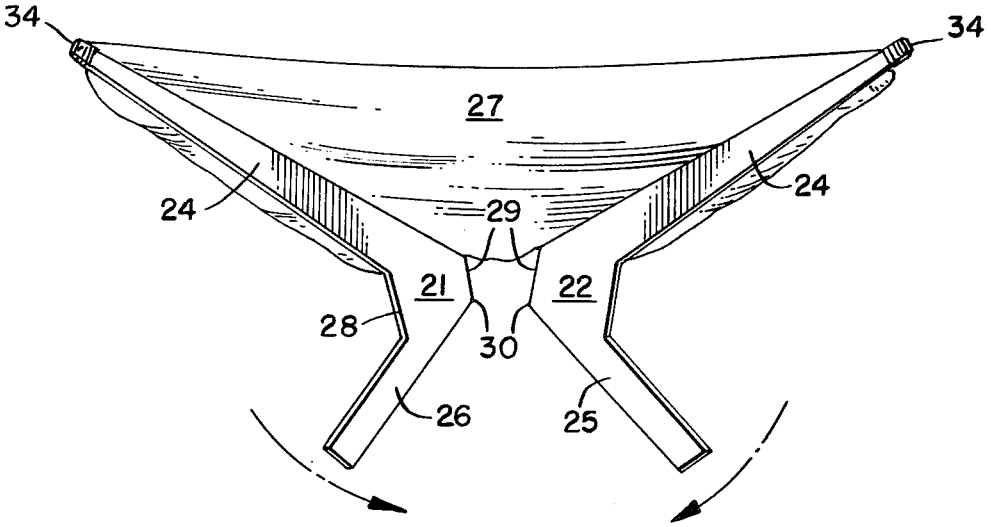
FIG. 3 is a view similar to FIG. 2 but with the setting up of the umbrella more advanced.
Figure 4:
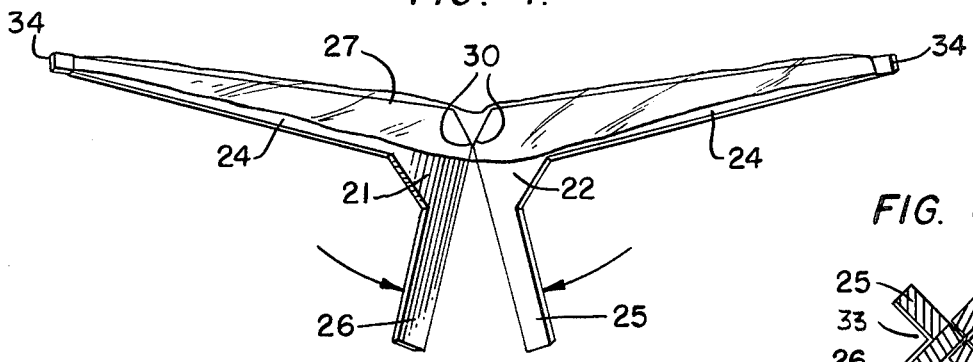
FIG. 4 is a view similar to FIG. 3 but with the setting up of the umbrella still more advanced.

As the handle portions 25, 25, and 25, 26 are rotated in the direction of the arrows shown in FIG. 2 to the position shown in FIG. 3 and then to the position in FIG. 4, the amplitude of the festoons decreases until it is almost zero and the peripheral margin of the canopy 27 is almost straight while the central portion of the canopy is still loose and the handle portions 25, 25, and 25, 26 are still not touching each other except as shown in FIG. 4 in which the upper ends 30 of the handle portions do not initiate engagement with each other.

Figure 6:
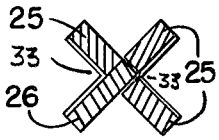
FIG. 6 is an enlarged somewhat exaggerated horizontal cross-section of the umbrella handle position taken along line 6—6 of FIG. 5 and looking in the direction of the arrows.
Figure 5:
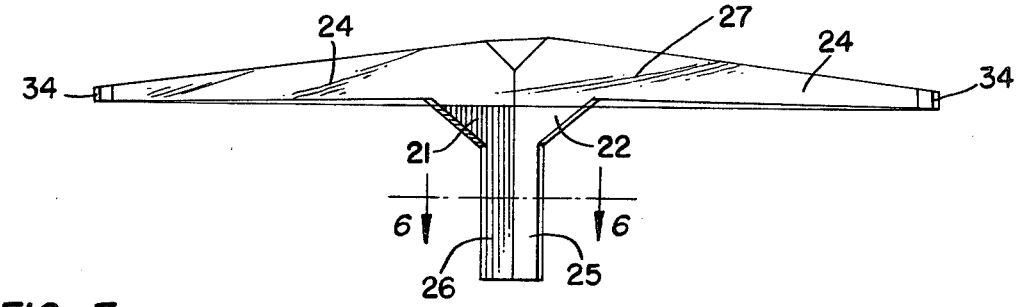
FIG. 5 is a view in side elevation of the umbrella in opened position and ready for service.
Figure 7:
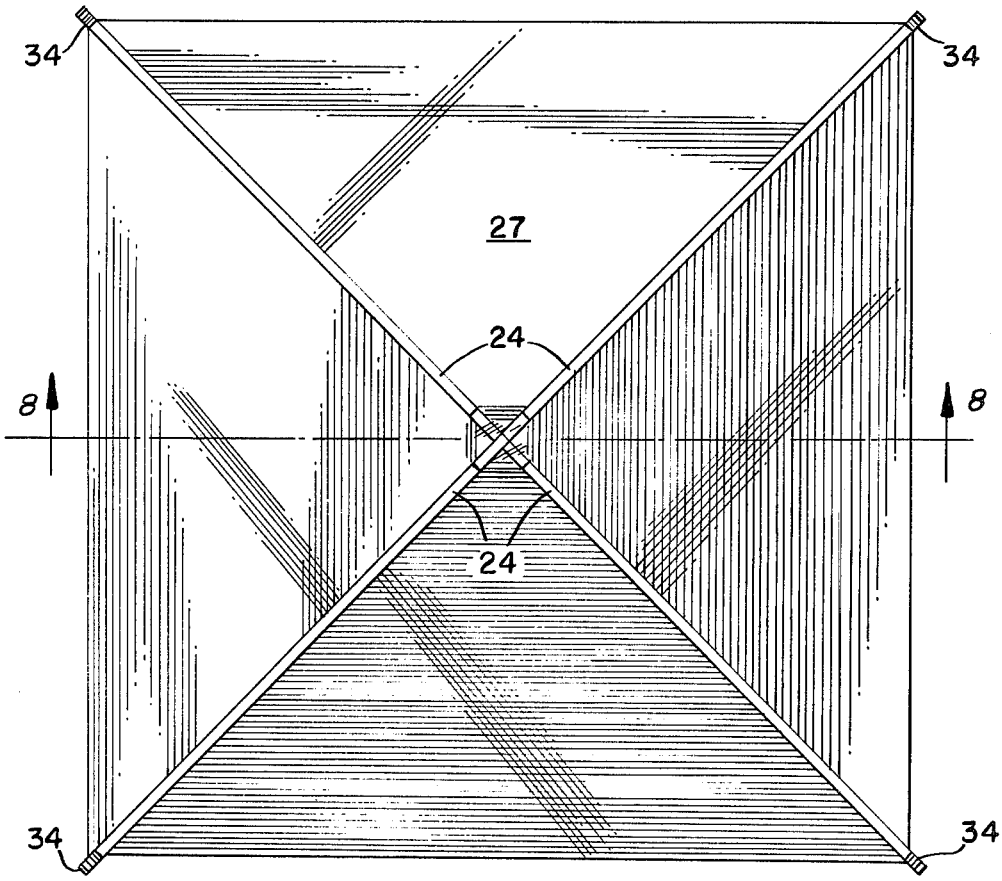
FIG. 7 is a plan view of the top of the umbrella illustrating the canopy as viewed from above.
Figure 8:
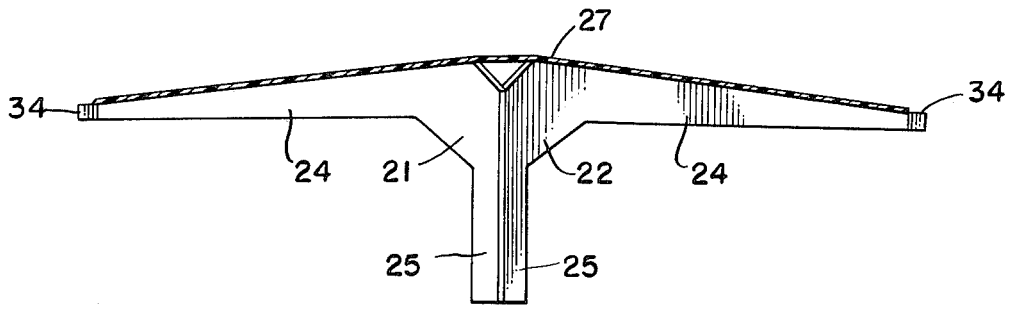
FIG. 8 is a vertical cross-section of the umbrella taken along line 8—8 of FIG. 7 and looking in the direction of the arrows.
Figure 9:
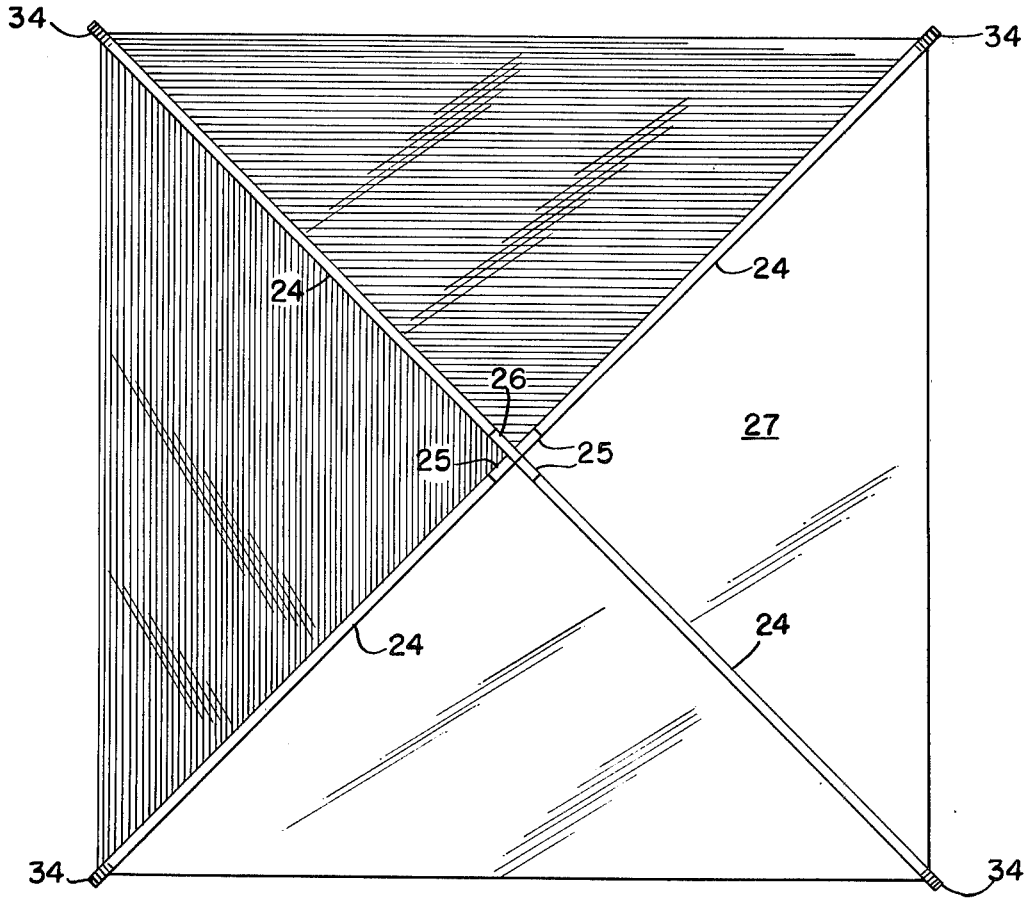
FIG. 9 is a plan view of the underside of the umbrella illustrating the canopy as viewed from below.

When the rotation of the handle portions is continued, the canopy 27 stretches and the toggle-like action takes place forcing the handle portions 25, 25, into interfitted relationship and 25, and 26 together in the position illustrated in FIGS. 6 and 5 in which the central portion of the canopy 27, as well as the remainder of the canopy 27, is taut. This handle interfitting relationship is made by the projecting margin on handle portion 26 with the V-shaped channel-like groove formed in the mating area of the first two hinged handle portions 25, 25. The umbrella is now set up for use as protection against rain.

To collapse the umbrella, the setting up process is generally reversed. The handle portions are pulled apart at their lower ends with their upper ends in engagement. The canopy 27 will cease to be in stretched condition as the handle portions continue to be rotated in the opposite direction from that shown on the drawings. The canopy 27 will then begin to festoon and the handle portion 25 will fold over the handle portion 26 and a second handle portion will fold over the third handle portion 25. Thereafter the two boomerang-shaped elements are brought together in one over the other relationship and the canopy furled and banded as shown in FIG. 1.

The umbrella of the instant invention is made of simple and inexpensive materials. For example, the boomerang-shaped elements of elements 21 and 22 may be fabricated from corrugated paperboard or molded plastic such as injection molded thermoplastic. For example, the canopy 27 may be cut from elastic plastic film such as clear polyethylene film.

The umbrella of the instant invention is inexpensive to manufacture and may be considered for one time use or multiple time use.

It will be obvious to those skilled in the art that various changes may be made without departing from the scope of the invention and the invention is not to be considered limited to what is shown in the drawings and described in the specification.

What is claimed is:

1. An umbrella comprising a combined handle and canopy support structure including four generally boomerang-shaped elements and an elastic and stretchable film canopy, two of said boomerang-shaped elements being hingedly connected to form a first set and two more of said boomerang-shaped elements being hingedly connected to form a second set, each of said boomerang-shaped elements including a canopy supporting boom portion and a handle portion, said two hinged connections being located along said handle portions, said canopy being secured to at least a portion of each of the four boom portions, said handle portions of the first set being in pressure contact with the handle portions of the second set under the influence of the tension forces in the canopy which is stretched when the umbrella is in open position with the boom portions angularly spaced from each other, three of the handle portions are identical and a fourth handle portion has a projecting margin which interfits with the V-shaped channel-like groove formed in the mating area of the first two hinged handle portions.

* * * * *